United States Patent [19]

Schrank et al.

[11] Patent Number: 4,900,234

[45] Date of Patent: Feb. 13, 1990

[54] REFRIGERANT INJECTION INTO OIL FOR SOUND REDUCTION

[75] Inventors: Douglas A. Schrank, Baldwinsville; Russell G. Lewis, Manlius, both of N.Y.

[73] Assignee: Carrier Corporation, Syracuse, N.Y.

[21] Appl. No.: 265,965

[22] Filed: Nov. 2, 1988

[51] Int. Cl.[4] ..... F04B 21/02

[52] U.S. Cl. ..... 417/312; 417/902; 62/296

[58] Field of Search ..... 417/312, 902; 184/6.26; 62/296; 181/403

[56] References Cited

U.S. PATENT DOCUMENTS 3,066,857 12/1962 McCloy ..... 417/902

3,155,312 11/1964 Douglas ..... 417/312

*Primary Examiner*—Leonard E. Smith

*Assistant Examiner*—John A. Savio, III

*Attorney, Agent, or Firm*—David J. Zobkiw

[57] ABSTRACT

In a low side hermetic compressor, a small portion of the compressed refrigerant gas is diverted and discharged into the oil sump through an orifice into the upper level of the oil in the sump. This results in a supersaturated solution of refrigerant in oil in the upper level which drives the refrigerant out of the oil, thereby creating froth which provides sound reduction without disturbing the lower level which remains stratified. A check valve is provided for preventing reverse flow while requiring a predetermined pressure differential for diversion.

6 Claims, 2 Drawing Sheets

10
11
12
13
15
17
18
20
30
-90-

10
11
12
13
14
15
16
17
18
19
20
30
2
2
-90-

REFRIGERANT INJECTION INTO OIL FOR SOUND REDUCTION

BACKGROUND OF THE INVENTION

The radiated sound level of hermetic compressors, is of extreme importance since, in residential applications, they are typically located in a window opening or the yard. High Performance of the compressor is also of importance. However, as compressor performance increases, the sound sources and paths are often altered resulting in unacceptable radiated sound levels. As a result, the twin goals of high performance and acceptable radiated sound levels are generally in conflict. Conventional sound reduction techniques such as the use of paddles on the oil pickup tube to generate a froth are often inadequate for high performance compressors.

SUMMARY OF THE INVENTION

In a low side hermetic compressor the compressed refrigerant discharged from the cylinders is directed to a muffler and then to the discharge line leading from the compressor. By diverting a small portion of the compressed refrigerant gas from a muffler body into the compressor oil, the oil is foamed which results in an attenuated path through which the sound must travel and a reduced radiated sound level. The nature of the foam generation is different than that generated by paddles. When paddles are used, the entrained refrigerant is removed from the oil and the oil is agitated by the stirring action of the paddles. In contrast, the present invention injects the high pressure refrigerant into the upper level of the oil without disturbing the lower level which remains stratified. This results in a supersaturated solution of refrigerant in oil in the upper level which drives the refrigerant out of the oil, thereby creating froth, since the inside of the shell of the compressor is at suction pressure. The lower level is undisturbed by all of this and remains a stable, saturated solution which is in equilibrium. Additionally, the upper level serves to dampen the effects of pressure drops on the lower level. The pressure drops are a normal consequence of compressor operation but can cause outgasing when the pressure is lowered. The dampening effect is because the froth is more sensitive to pressure changes than the lower level.

The length and placement of the orifice body as well as the size of the orifice are important. The orifice body should be vertically located in the lower portion of the muffler body with the refrigerant gas escaping downward. The orifice body should be of a sufficient length to extend a sufficient depth into the oil sump to permit the supersaturation of the oil with refrigerant. Also, the orifice body should provide a flow path of a sufficient length and relatively small cross section to shield the orifice from the pressure oscillations in the muffler body. The orifice itself should be of such a dimension as to prevent the discharge of too much refrigerant from the muffler while permitting sufficient foam generation. These combined design parameters allow proper sound attenuation without a significant loss in compressor performance. However, because the orifice provides a fluid path between the suction and discharge, there is a potential for reverse flow as part of the pressure and temperature balancing occurring upon shutdown of the compressor. Specifically, since the orifice is below the surface of the oil, there is a tendency for oil to enter the orifice body and even the muffler and discharge line. To prevent this reverse flow, a check valve is provided in the orifice body.

It is an object of this invention to provide a method and apparatus for reducing radiated sound levels in hermetic compressors.

It is a further object of this invention to generate foam while preventing reverse flow upon shutdown.

It is an additional object of this invention to maintain a discharge bleed function during normal operation while preventing oil migration during system thermal cycles prior to system start up.

It is another object of this invention to provide a method and apparatus for foam generation. These objects, and others as will become apparent hereinafter, are accomplished by the present invention.

Basically, refrigerant at compressor discharge pressure is bled from the muffler through an orifice body containing a check valve and an orifice and discharges into the upper level of the oil in the sump. This creates a supersaturated solution at the upper level which causes refrigerant gas to be given off thereby creating foam or froth with a resultant reduction in radiated sound levels.

BRIEF DESCRIPTION OF THE DRAWINGS

For a further understanding of the present invention, reference should now be made to the following detailed description thereof taken in conjunction with the accompanying drawings wherein.

DESCRIPTION OF THE PREFERRED EMBODIMENT

Figure 2:
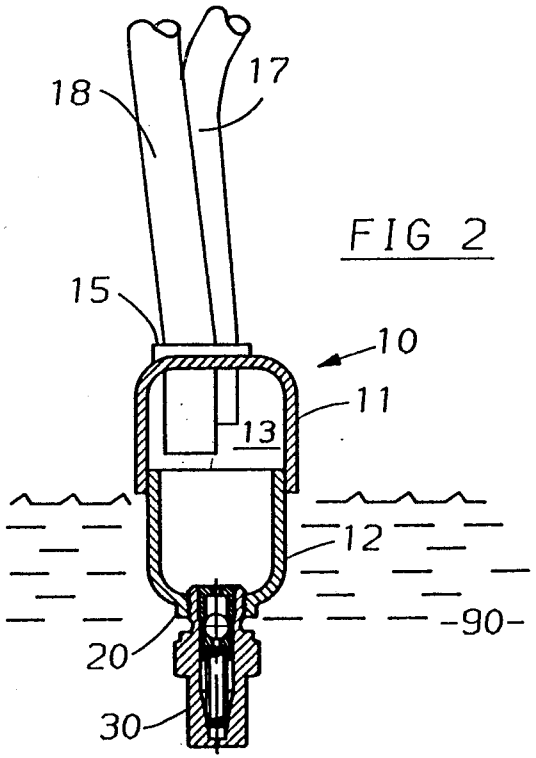
FIG. 2 is a sectional view taken along line 2—2 of FIG. 1.
Figure 1:
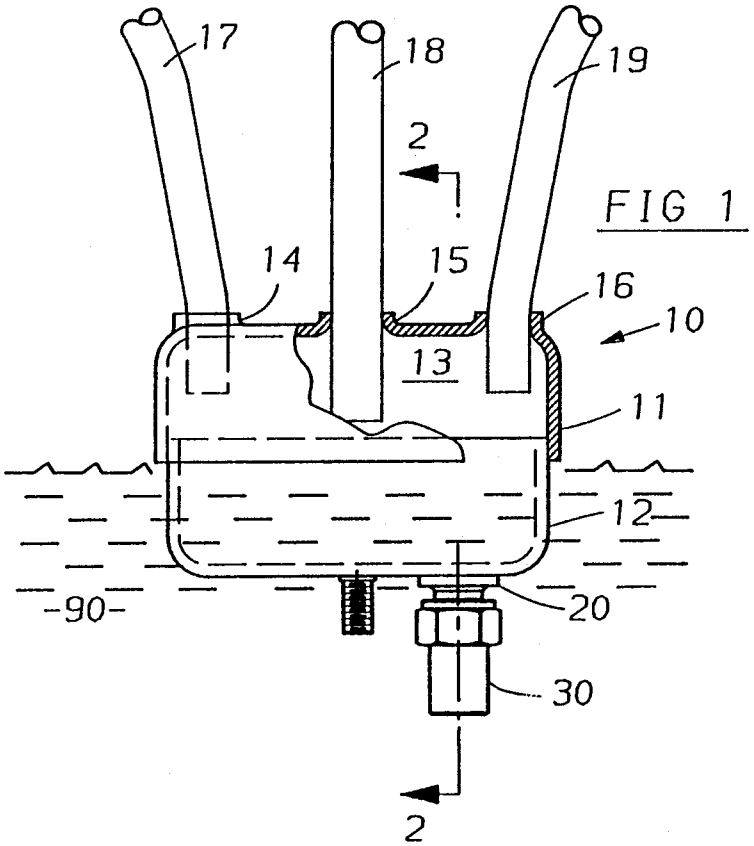
FIG. 1 is a partially cutaway view of a muffler assembly.
Figure 3:
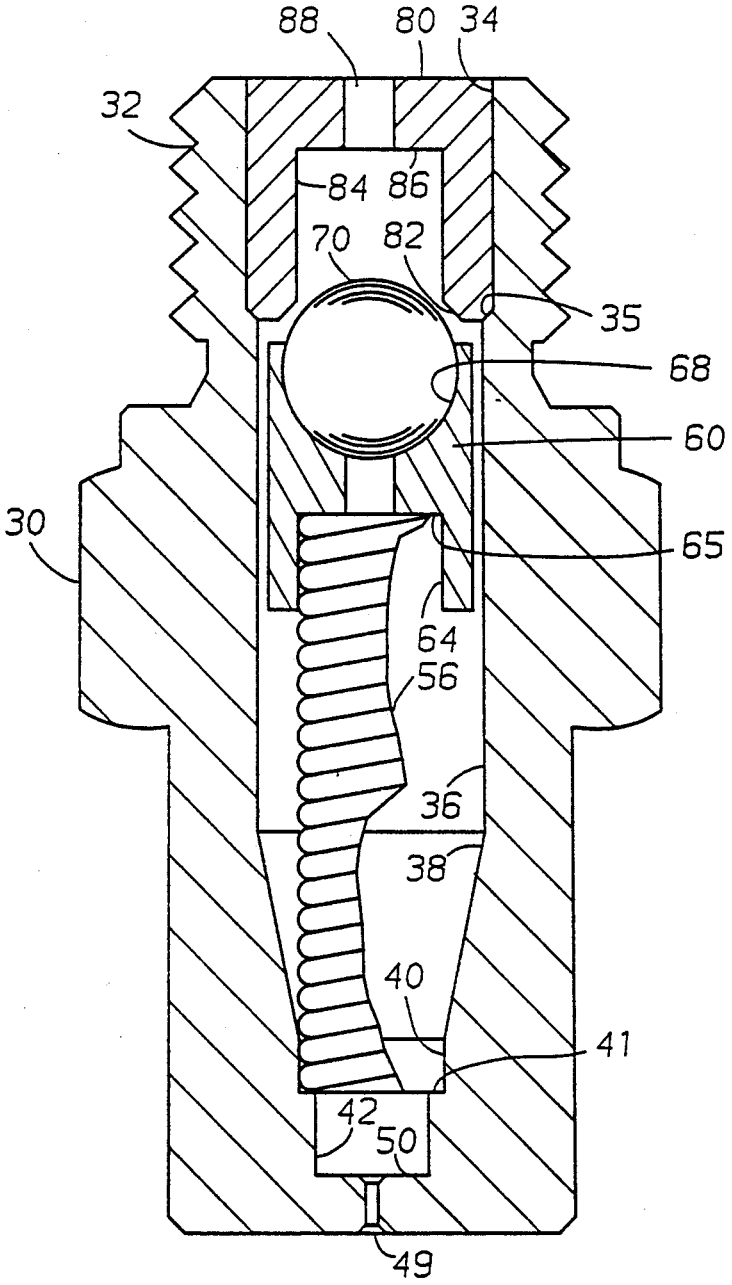
FIG. 3 is an enlarged, partially cutaway, sectional view of the orifice body and check valve assembly shown in FIG. 2.

In FIGS. 1 and 2, the numeral 10 generally designates a muffler assembly for use in a hermetic compressor including a top portion 11 and a bottom portion 12 which are brazed or otherwise suitably joined together in a fluid tight manner to form muffler chamber 13. Collars 14, 15 and 16 are formed in top portion 11 for respectively receiving header 17, discharge line 18 and header 19. Threaded collar 20 is formed in bottom portion 12 for threadably receiving orifice body 30. Referring now to FIG. 3, orifice body 30 has a threaded portion 32 for threadably engaging threaded collar 20. A first bore 34, a second bore 36, a third bore 38 which is tapered, a fourth bore 40 and a fifth bore 42, each of a progressively reduced diameter, are serially formed in orifice body 30 with shoulder 35 formed between bores 34 and 36 and shoulder 41 formed between bores 40 and 42.

Bore 40 acts as a spring retainer. Shoulder 41 serves as a seat for spring 56. An orifice 49 is formed in end wall 50 and has a nominal diameter of 0.0165 inches in the preferred embodiment. Valve piston 60 is reciprocatably located in bore 36. Valve piston 60 has a bore 64 formed therein which terminates at shoulder 65 such that coil spring 56 is received in bore 64 and seats on shoulder 65. Recess 68 which generally defines a portion of a sphere is formed in valve piston 60 on the opposite side from, and coaxial with, bore 64. Spherical valve member 70 is made of a suitable material such as steel and is received in bore 68 in a force fit. Valve seat member 80 is press fit into bore 34 and is preferably in engagement with shoulder 35. Valve seat member 80 has a bore 84 formed therein which terminates in end wall 86 at one end and is surrounded by tapering valve seat 82 at the other. End wall 86 has a fluid passage 88 formed therein which has a nominal diameter of 0.03 inches in the preferred embodiment.

In operation, as best shown in FIG. 1, the orifice body 30 extends vertically into the oil sump 90 for a distance of approximately two inches. In the illustrated two-cylinder configuration, compressed refrigerant from each of the compressor cylinders (not illustrated) is delivered to chamber 13 of muffler assembly 10 via headers 17 and 19, respectively. Most of the compressed refrigerant passes from chamber 13 via discharge line 18 which delivers the refrigerant to the condenser (not illustrated) of a refrigeration system. According to the teachings of this invention, a small portion of the compressed refrigerant passes from chamber 13 via orifice body 30. Specifically, refrigerant from chamber 13 passes via passage 88 into bore 84 in orifice body 30. The refrigerant in bore 84 acts against valve member 70 carried by valve piston 60 in opposition to the bias provided by spring 56. If the pressure of the refrigerant is sufficient, it will cause valve member 70 to be unseated, as illustrated, thereby opening a fluid path between muffler chamber 13 and oil sump 90. The refrigerant can then serially pass from chamber 13 through passage 88, bore 84, past valve member 70, past valve piston 60, between the coils of spring 56, through bore 42 and then through orifice 49 into sump 90.

Since the refrigerant entering orifice 49 is at compressor discharge pressure while the refrigerant vapor above the oil sump 90 is at compressor suction pressure, the refrigerant discharged into the oil sump is injected into the upper level of the oil in sump 90 without disturbing the lower level. This results in a supersaturated solution of refrigerant in oil in the upper level of the oil in sump 90 which drives the refrigerant out of the oil and produces sound reducing froth due to the presence of suction pressure over the oil sump 90. The lower level is undisturbed by the injection of refrigerant and remains a stable saturated solution which is in equilibrium and dampened by the upper level from the effects of normal pressure fluctuations in operation. The response of spring 56 is such that the desired metered flow of refrigerant into the sump takes place when there is a pressure differential of at least 100 PSIG. When the pressure differential is too low, or negative as in the situation tending to produce reverse flow, valve 70 remains seated under the bias of spring 56 and fluid pressure under a reverse pressure differential. This prevents the flow of any gas and/or liquid from the sump 90 to the chamber 13 thereby eliminating the potential path for oil migration.

Although a preferred embodiment of the present invention has been illustrated and described, other modifications will occur to those skilled in the art. It is therefore intended that the present invention is to be limited only by the scope of the appended claims.

What is claimed is:

1. A method for reducing radiated sound levels in low side hermetic compressors comprising the steps of:

supplying pressurized refrigerant to a muffler which is in fluid communication with a discharge line;

diverting a small portion of the pressurized refrigerant supplied to the muffler when the pressure in the muffler is at least 100 p.s.i. above the low side pressure;

injecting the diverted pressurized refrigerant into an oil sump at a point beneath the surface of the oil whereby a supersaturated solution of refrigerant in oil is created in the upper level of the oil in the sump which drives the refrigerant out of the oil in the upper level to create a froth without disturbing the lower level of the oil in the sump; and preventing the flow of oil from the sump to the muffler.

2. The method of claim 1 wherein the step of injecting the diverted refrigerant takes place by discharging the diverted refrigerant downwardly in the sump at a distance of approximately two inches beneath the surface of the oil.

3. The method of claim 1 wherein the step of injecting the diverted refrigerant passes the diverted refrigerant through an orifice 0.0165 to 0.018 inches in diameter.

4. Refrigerant injection apparatus for foam generation in a low side hermetic compressor having an oil sump comprising:

muffler means having header structure for delivering compressed refrigerant to said muffler means and p1 a discharge line for conveying compressed refrigerant from said muffler means;

diverting means connected to said muffler means for diverting a small portion of said compressed refrigerant delivered to said muffler means and including orifice means discharging said diverted refrigerant beneath the surface of said oil sump to generate foam; and check valve means located between said muffler means and said orifice means for permitting flow from said muffler means only upon a sufficient pressure differential between said muffler means and said oil sump and for preventing flow from said oil sump to said muffler means.

5. The apparatus of claim 4 wherein said orifice means is 0.0165 to 0.018 inches in diameter.

6. The apparatus of claim 4 wherein said orifice means discharges approximately two inches below the surface of said oil sump.

* * * * *